United States Patent [19]

Dzurak

[11] Patent Number: 4,754,102

[45] Date of Patent: Jun. 28, 1988

[54] DIRECTIONAL INTERCONNECTION CABLE FOR HIGH FIDELITY SIGNAL TRANSMISSION

[76] Inventor: Thomas J. Dzurak, 2016 Flintbury Ct., San Jose, Calif. 95148

[21] Appl. No.: 57,280

[22] Filed: Jun. 2, 1987

[51] Int. Cl.[4] ..... H01B 11/00

[52] U.S. Cl. ..... 174/36; 174/32; 174/34; 333/1

[58] Field of Search ..... 174/32, 34, 36; 333/1, 333/12, 243

[56] References Cited

U.S. PATENT DOCUMENTS

| | | | |
|---|---|---|---|
| 2,958,724 | 11/1960 | Milloit | 174/34 |
| 3,815,054 | 6/1974 | McClure et al. | 174/34 X |
| 4,388,486 | 6/1983 | Nakatsuka | 174/36 X |
| 4,593,153 | 6/1986 | Kuhn et al. | 174/36 X |
| 4,599,483 | 7/1986 | Kuhn et al. | 174/36 |
| 4,661,674 | 4/1987 | Inoue | 174/32 X |

*Primary Examiner*—Morris H. Nimmo

*Attorney, Agent, or Firm*—Limbach, Limbach & Sutton

[57] ABSTRACT

A directional transmission cable is disclosed which has a plurality of insulated conductive wires. The cable also has a source terminal and a destination terminal. A first connection of a collection of more than one of the wires is made to the source terminal. A second connection of less than all of the collection of wires is made to the destination terminal. A faithful transmission of a signal is made from the source terminal to the destination terminal.

12 Claims, 1 Drawing Sheet

DIRECTIONAL INTERCONNECTION CABLE FOR HIGH FIDELITY SIGNAL TRANSMISSION

FIELD OF THE INVENTION

This invention relates to the field of interconnection cables. More particularly this invention relates to interconnection cables for high fidelity signal transmission for sound reproduction applications.

BACKGROUND OF THE INVENTION

In high fidelity sound reproduction, the obvious goal is to reproduce as nearly and precisely an exact copy of the original as possible. Because the state of the art of the electronic and recording medium have improved so vastly in the recent decades, the interconnect cables used between system components and to loud speakers are now a limiting source of sound reproduction quality.

It is an object of the present invention to provide interconnect cables for high fidelity signal reproduction which more accurately reproduce the original sound quality.

SUMMARY OF THE INVENTION

The present invention includes a cable having a first terminal at a first end and a second terminal at a second end for transmitting a signal from the first end to the second end including a plurality of wires which extend from the first end to the second end. The wires are electrically coupled to one another at the first end. Only certain of the wires are electrically coupled to one another and to the second terminal at the second end. The remainder of the wire terminate near the second end and are electrically insulated from one another.

BRIEF DESCRIPTION OF THE DRAWINGS

In the various figures like numeral are used to represent like elements.

DETAILED DESCRIPTION OF THE PREFERRED EMBODIMENT

Figure 1:
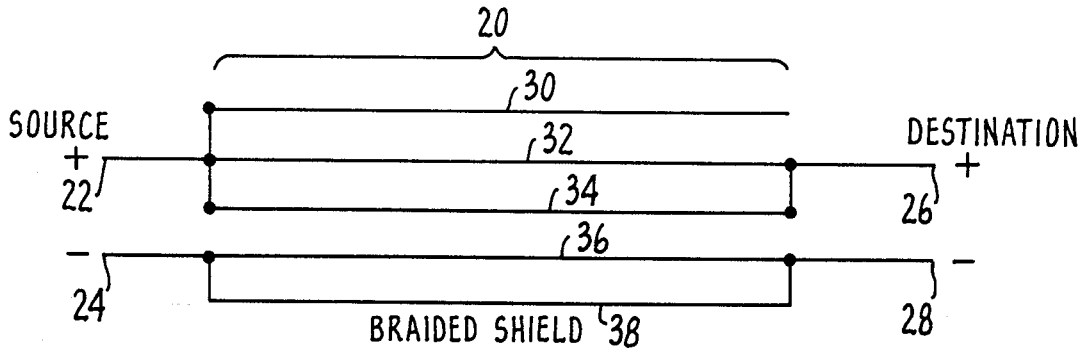
FIG. 1 shows a schematic view of the preferred embodiment of the present invention.

FIG. 1 shows a schematic representation of a four conductor insulated cable with a braided shield. Each conductor is a wire group having 19×30 AWG (American Wire Gauge) stranding with its own separate insulation. Each conductor may be thinner than the preferred so long as sufficiently thick as to effectively carry the signal; typically no less than 30 gauge. The cable is used to transmit a signal that is applied to its positive source terminal 22 and negative source terminal 24 through the entire length of the cable to its positive destination terminal 26 and negative destination terminal 28. The four wires 30, 32, 34, and 36 run the length of the cable and are each wires and their respective insulation 40 are surrounded by a braided shield 38. The braided shield is enclosed by on insulation 42 shown in FIG. 2.

The three wires 30, 32 and 34 form the positive signal transmission means. At the positive source terminal 22, the three wires 30, 32, and 34 are electrically coupled together, preferably by soldering. The three wires 30, 32 and 34 each run the length of the cable. At the destination end only conductive wires 32 and 34 are connected to the positive destination terminal 36. Wire 30 is terminated and insulated form wires 32 and 34. Such insulation means may include a heat treated shrink wrap tubing which covers any exposed portion of conductive wire 30 electricians tape or an insulative silicone resin. To form the negative or ground transmission means, wire 36 and shield 38 are electrically coupled together at negative source terminal 24 and also at negative destination terminal 28. The preferred method for such coupling is by soldering.

Figure 2:
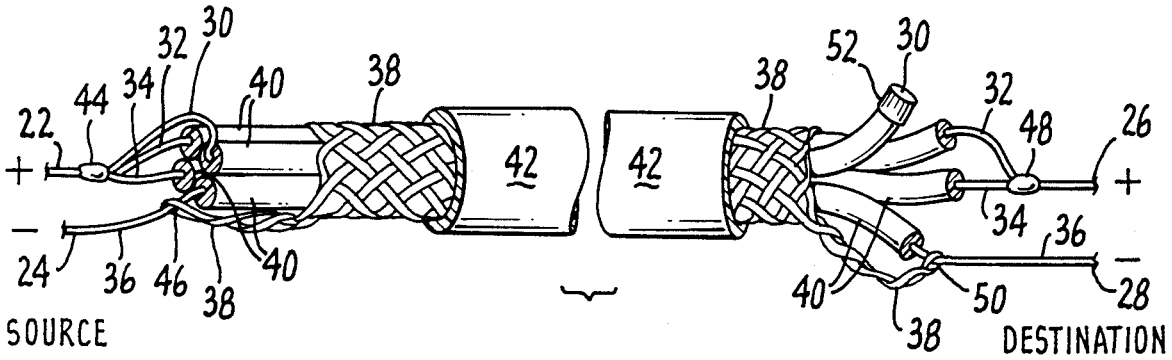
FIG. 2 shows a side view of the preferred embodiment of the present invention.

FIG. 2 shows a graphical representation of the preferred embodiment of the present invention. The four wires 30, 32; 34 and 36 are each encased in its own insulation sheath 40. All of the four conductive wires 30, 32, 34 and 36 and their respective insulating shields 40 are encased in a conductive braided shield 38. The braided shield in turn is encased in an outer insulative protecting layer 42. The positive source terminal 22 is shown to be connected to conductive wires 30, 32, and 34 by a solder bond 44. The positive destination terminal end wires 32 and 34 are shown to be connected together by solder bond 48. Wire 30 and its respective insulation shield 40 are shown to be covered at the end of an electrically insulated from the remainder of the conductive elements of the cable by heat treated shrink wrap tube terminator 52. Wire 32 and 34 are electrically coupled to positive designation terminal 26.

Likewise, the braided shield 38 is shown to be connected to wire 36 by a soldered bond 46 and then the negative source terminal 24. Wire 36 and braided shield 38 are coupled to negative destination terminal 28. Wire 36 and braided shield 38 are shown to be connected together through solder bond 46 at the negative source terminal 24 and by solder bond 50 at the negative destination terminal 28.

Figure 3:
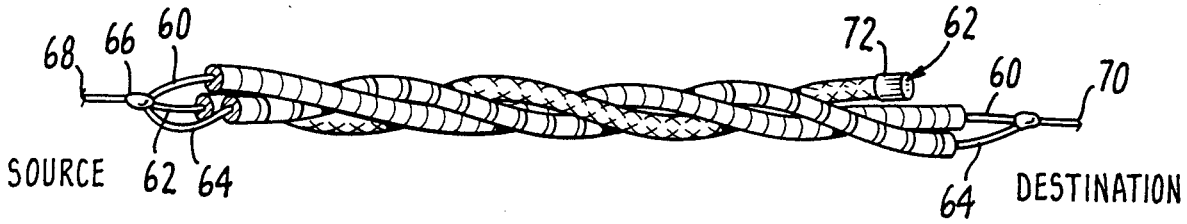
FIG. 3 shows an alternate embodiment of the present invention.

The alternate embodiment of the present invention in FIG. 3 shows a cable for a single polarity transmission line. Here a twisted three wire strand formed of wires 60, 62 and 64 are coupled together at the source end by a solder bond 66. At the destination end 70 conductor 60 and 64 are connected to destination terminal 70. Conductor 62 is insulated from the remainder of the conductive material by a heat treated shrink wrap terminator 72. Certain applications may require the use of more conductors. Other applications may require that a greater number of conductors be terminated with an insulating terminator at the positive destination end of the cable. Such multiple terminated conductors may be terminated separately or be coupled together.

In the preferred embodiment each wire is preferably formed of 19×30 AWG=18 AWG gauge oxygen-free copper protected by a coating of silver. Oxygen-free copper is 99.995% pure copper having 3 to 5 ppm of oxygen in the wire as compared to 99.95 pure copper having approximately 300 ppm oxygen in standard tough pitch copper wire. The outer cable insulator 42 is formed of TFE Teflon material. The insulator 40 around each of he conductors is formed of TFE Teflon 0.010 mils thick. The spacing each of the insulated conductors within the center of the cable is 0.020 mils.

The use of TFE Teflon is preferred over the prior art use of polypropylene. The surface of a polypropylene insulator 40 is relatively rough. The passage of current through a conductor surrounded by such an insulator results in changes to the dielectric coefficient of the insulator due to changes in the surface topology of the insulator. TFE Teflon has a relatively smooth finish and as such has reduced changes over time. The dielectric constant of polypropylene is about 2.50–2.56 times the dielectric constant of free air at 1 KHz and 60 Hz, 20°C. The dielectric constant of TFE Teflon is about 2.0–2.1 times of the dielectric constant of free air under the same conditions. The use of TFE Teflon results in a significant improvement in the long term consistency and integrity of signal transmission.

Experimental results show a marked improvement in harmonic purity, sound stage dimentionality, detail definition, transient attach and bass impact (sound quality) when using a cable of the present invention utilized with the proper orientation of source and destination terminals over prior art cables. In reverse polarity the cable of the present invention shows the marked decrease in performance with respect to sound quality over the prior art.

An improved high fidelity transmission cable is disclosed which greatly enhances the integrity of the transmitted signal as evidence by improved veil and haze sound characteristics. It is clear that the source destination characteristics of the cable described in the preferred embodiment of the present invention may be practiced using a number of modifications to the described preferred embodiment. Such modifications may include different materials of manufacture, and differing number of conductors coupled to both the source and destination ends. In certain applications this technique may be used for both positive and ground transmission terminals.

What is claimed is:

1. A directional transmission cable having a first signal transmitting means with a plurality of insulated conductive first wires comprising:

a. a first source terminal;

b. a first destination terminal;

c. a first connection to said source terminal of a collection of more than one of said wires for receiving a signal; and d. a second connection to said destination terminal of less than all of said collection for transmitting said signal wherein at least one wire of said collection is connected to said source terminal and is open circuited near said destination terminal.

2. The transmission cable according to claim 1 having a second signal transmitting means comprising:

a. a second source terminal;

b. a second destination terminal; and c. a second wire coupled between said second source terminal and said second destination terminal.

3. The transmission cable according to claim 2 further comprising a braided shield surrounding said plurality of first wires and said second wire, said shield coupled to said second wire.

4. The transmission cable according to claim 3 further comprising a flexible outer insulation jacket which encases said shield.

5. The transmission cable according to claim 4 wherein each of said plurality of insulated conductive first wires and said second wire have an insulator, further wherein the insulator of at least one of said insulated conductive first wires or said second wire is formed of TFE Teflon.

6. The transmission cable according to claim 5 wherein said plurality of first wires and said second wire are formed of oxygen-free copper.

7. The transmission cable according to claim 6 wherein said oxygen-free copper is protected by a coating of silver.

8. The transmission cable according to claim 7 wherein said plurality of first wires and said second wire are insulated by a TFE Teflon insulator.

9. The transmission cable according to claim 8 wherein each said plurality of first wire and said second wire are at least 30 gauge.

10. The transmission cable according to claim 9 wherein said Teflon is at least 0.10 mils thick.

11. A transmission cable comprising:

a. a positive source terminal;

b. a negative source terminal;

c. a positive destination terminal;

d. a negative destination terminal;

e. a first wire, a second wire, a third wire and a fourth wire, each having a Teflon insulation;

f. a conductive braided shield encasing said wires;

g. an insulation coating encasing said braided shield;

h. a first connection between said first wire, said second wire, said third wire and said positive source terminal;

i. a second connection between said first wire, said second wire and said positive destination terminal;

j. a third connection between said fourth wire, said braided shield and said negative source terminal;

k. a fourth connection between said fourth wire, said braided shield and said negative destination terminal; and l. an insulative terminator covering an end of said third wire not connected to said positive source terminal.

12. The cable according to claim 11 wherein said first wire, said second wire, said third wire and said fourth wire are formed of oxygen-free copper encased in a protective coating of silver.

* * * * *